US007250020B2

(12) United States Patent
Barbafieri et al.

(10) Patent No.: US 7,250,020 B2
(45) Date of Patent: Jul. 31, 2007

(54) ARTIFICIAL CLIMBING HOLD INCLUDING A SAFETY SYSTEM

(75) Inventors: Gérard Barbafieri, Marseilles (FR); Philippe Moreau, St Vincent de Mercuze (FR); Henri Miceli, Marseilles (FR)

(73) Assignee: Investissement Sport Developpement, Marseilles (FR)

( * ) Notice: Subject to any disclaimer, the term of this patent is extended or adjusted under 35 U.S.C. 154(b) by 548 days.

(21) Appl. No.: 10/303,813

(22) Filed: Nov. 26, 2002

(65) Prior Publication Data

US 2003/0100407 A1 May 29, 2003

(30) Foreign Application Priority Data

Nov. 28, 2001 (FR) ..... 01 15467

(51) Int. Cl.
*A63B 21/00* (2006.01)

(52) U.S. Cl. ..... 482/35; 482/23; 482/36

(58) Field of Classification Search ..... 470/8; 482/35, 37, 51

See application file for complete search history.

(56) References Cited

U.S. PATENT DOCUMENTS 6,074,327 A * 6/2000 Franklin ..... 482/37
6,475,094 B1 * 11/2002 Bruns et al. ..... 470/8

FOREIGN PATENT DOCUMENTS

DE 44 23 162 A1 1/1996
FR 2 595 049 A 9/1987

OTHER PUBLICATIONS

Building your climbing wall Ramsay Thomas) 1995 CHockstone Press Evergreen Colorado 80439.*

* cited by examiner

*Primary Examiner*—Jerome Donnelly
(74) *Attorney, Agent, or Firm*—Oliff & Berridge, PLC

(57) ABSTRACT

A removable artificial climbing hold comprising a molded or cast body having an opening for a threaded fastener to pass through, and safety means incorporated in the body around the opening to retain the debris in the event of the body breaking.

12 Claims, 1 Drawing Sheet

ARTIFICIAL CLIMBING HOLD INCLUDING A SAFETY SYSTEM

BACKGROUND OF THE INVENTION

Removable climbing holds are designed for climbing training and exercises on a wall, on an artificial climbing surface, or on an individual apparatus.

All known removable holds are fixed to their support by means of a mechanical bolt. Such a bolt fixing system enables the climbing hold to be moved, rotated, removed or changed.

The holds are generally manufactured from molded resin material, and the presence of the hole for passage of the bolt in the middle area does however cause a weakening of the mechanical strength of the hold. When the bolt is tightened too tightly, or during the climber's climbing exercise, this type of hold can break. The bits of the broken hold are then liable to fall onto the people standing near the climbing wall. The climber hanging on to the broken hold is also likely to fall, and is further secured by the cord attached to its harness.

The document U.S. Pat. No. 6,074,327 describes a climbing hold which is capable of being securely fastened to a climbing wall without fracturing. A reinforcing sleeve is therefore secured within the aperture of the hold body, so as to support a portion of the fastener. The sleeve includes a tubular portion extending through the aperture, and radially extending end faces to prevent translation of said hold body when mounted to the climbing wall. The presence of this tubular sleeve cannot prevent the hold to break when the bolt is tightened too tightly.

OBJECT OF THE INVENTION

One object of the invention is to overcome these shortcomings and to achieve a climbing hold designed to prevent debris and a climber from falling in the event of a break.

Another object of the invention is also to increase the mechanical strength of the handhold.

The invention consists to realize a removable artificial climbing hold comprising a body having an opening for a threaded fastener to pass through, and safety means incorporated in the body around the opening to strengthen the body and retain the debris in the event of the body breaking.

The handhold may have a body made of molded resin, or made of cast material, such as synthetic plastic, polyurethane, metal, ceramics, etc. The threaded fastener extending through the opening of the body is for example a bolt.

The safety means may include a malleable or a resilient metallic or non metallic structure. The safety means can be formed by a steel wire or by a wire made of any other material, by a wire mesh, a cloth or any other material having a spring effect and not able to break when a large folding occurs.

It is also possible to use rigid material, such as rigid plastic or metal rods, or rigid plastic or metal sheets embedded in the molded or cast body. The presence of these rods or sheets not only serve to hold the body together after it shattered, but also increase the breaking strength of the body.

The structure of these safety means advantageously comprises a hole whose diameter is preferably at least equal to the diameter of the opening of the body and smaller than the diameter of the head of the securing bolt.

When a break of the climbing hold according to the invention takes place, the different parts of the hold remain attached around the bolt by the safety means, guaranteeing the safety of the people standing at the bottom of the climbing wall, and helping also to ensure the safety of the climber using the hold.

The invention relates also to a method of making an artificial handhold for removable attachment to a climbing wall, the method comprising embedding a safety means in the body of the handhold during formation of the body, with the safety means extending laterally within the body from adjacent a central opening in the body through a substantial lateral extent of the body, thereby to retain body debris if the body should subsequently break during use.

DESCRIPTION OF THE INVENTION

Figure 1:
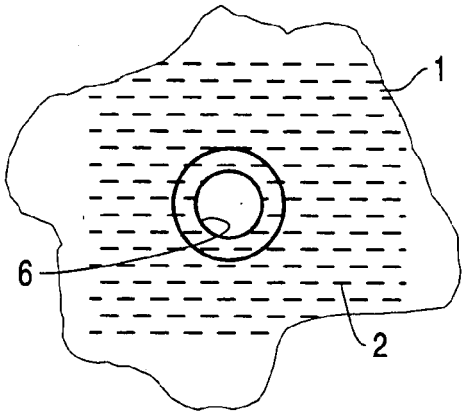
FIG. 1 shows a front view of the removable climbing hold according to the invention.

In FIG. 1 the body (1) of the hold is made for example of resin-based molded plastic material, or cast material, such as synthetic plastic, polyurethane, metal, ceramics, etc.

The body (1) comprises an opening (6) for the securing bolt (5) to pass through. Inside the body (1) there are located safety means (in broken lines), formed for example by a reinforcing wire mesh or brace (2). A hole (7) is arranged within said brace whose diameter is preferably at least equal to the diameter of the body (1) and smaller than the diameter of the head of the securing bolt (5). The brace (2) can be metallic or non-metallic.

Figure 2:
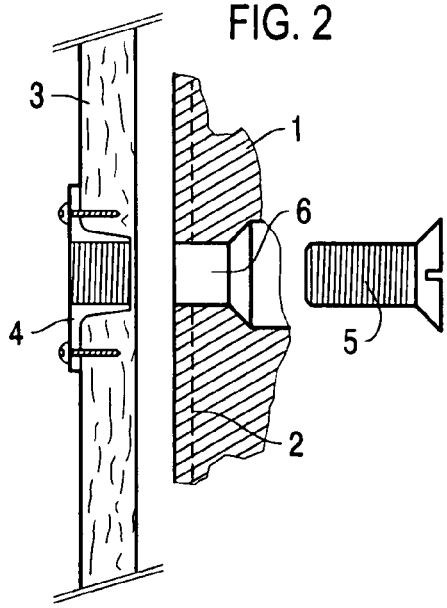
FIG. 2 is a cross-sectional view of the hold together with the bolt and the climbing wall.

FIG. 2 is a cross-sectional view of the hold with the support or climbing wall (3) able to be made of resin, wood or any other rigid material, and wherein there is housed a threaded insert (4). The body (1), brace (2) of the safety means, and opening (6) are arranged so as to allow passage of the securing bolt (5).

Figure 3:
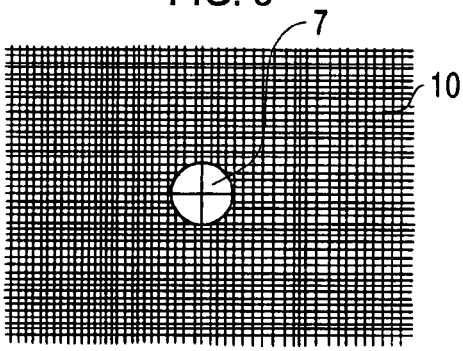
FIGS. 3, 4 and 5 show plan views of different embodiments of the securing means embedded in the body of the hold.

In FIG. 3, the safety means comprise a piece of cloth (10) having a hole (7) with an identical dimension to that of FIG. 1.

Figure 4:
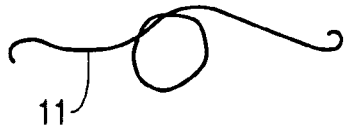

FIG. 4 illustrates safety means in the form of a wire (11) made of steel or other material, forming a loop surrounding the shank of the securing bolt (5). The loop is smaller than the diameter of the head of the securing bolt (5). Several wires can be placed around the bolt (5) in one and the same hold.

Figure 5:
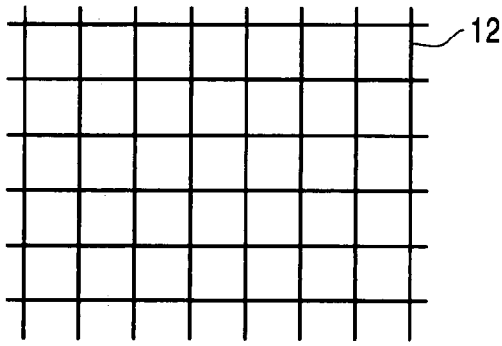

In FIG. 5, the safety means comprise a grating (12) made of metal, plastic or any other flexible material, the dimension of the meshes of the grating corresponding to the above-mentioned hole (7).

Figure 6:
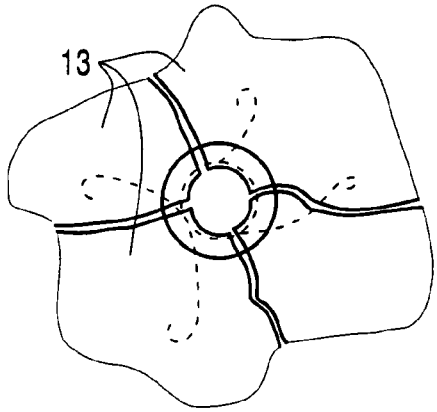
FIG. 6 represents a broken hold shown in plan view with the bits remaining attached to the bolt by the securing means.

FIG. 6 represents a broken hold with the bits of hold (13) attached to one another by the wires (11) of FIG. 4, which wires remain securedly attached to the bolt (5).

The invention claimed is:

1. A removable artificial climbing hold comprising a body having an opening for a threaded fastener to pass through, the body being made of resin-base plastic material, and safety means for retaining debris incorporated totally within the body around the opening when a molding operation is performed, wherein the safety means for retaining, retains debris in the event of the body breaking.

2. A removable artificial climbing hold according to claim 1, wherein the threaded fastener is a bolt.

3. A removable artificial climbing hold according to claim 1, wherein the safety means includes a malleable structure.

4. A removable artificial climbing hold according to claim 1, wherein the safety means includes a resilient structure.

5. A removable artificial climbing hold according to claim 1, wherein the safety means comprises a metallic structure.

6. A removable artificial climbing hold according to claim 1, wherein the safety means comprises a non metallic structure.

7. A removable artificial climbing hold according to claim 5, wherein said structure is arranged to increase the breaking strength of the body.

8. A removable artificial climbing hold according to claim 1, wherein the safety means comprises at least a retaining wire forming a loop surrounding said threaded fastener.

9. A removable artificial climbing hold according to claim 1, wherein the safety means comprises a piece of cloth.

10. A removable artificial climbing hold according to claim 2, wherein said safety means is provided with a hole having a diameter which is at least equal to the diameter of the opening of the body, and smaller than the diameter of the head of the bolt.

11. Climbing wall equipped with removable artificial climbing holds according to claim 1.

12. A removable artificial climbing hold according to claim 1, wherein a threaded fastener extends through the opening in the body for removable attachment of the hold to a climbing wall.

* * * * *